US009028619B2

(12) United States Patent
Hewitt

(10) Patent No.: US 9,028,619 B2
(45) Date of Patent: May 12, 2015

(54) SYSTEM AND METHOD FOR CLEANING TOKENS

(71) Applicant: Phillip Alston Hewitt, Huntington Beach, CA (US)

(72) Inventor: Phillip Alston Hewitt, Huntington Beach, CA (US)

( * ) Notice: Subject to any disclaimer, the term of this patent is extended or adjusted under 35 U.S.C. 154(b) by 0 days.

(21) Appl. No.: 14/258,559

(22) Filed: Apr. 22, 2014

(65) Prior Publication Data

US 2014/0224276 A1 Aug. 14, 2014

Related U.S. Application Data

(62) Division of application No. 13/252,769, filed on Oct. 4, 2011, now Pat. No. 8,746,260.

(51) Int. Cl.

| | |
|---|---|
| ***B08B 9/20*** | (2006.01) |
| ***B08B 3/04*** | (2006.01) |
| ***B08B 3/12*** | (2006.01) |
| ***B08B 11/02*** | (2006.01) |
| ***B08B 13/00*** | (2006.01) |
| ***G07D 9/00*** | (2006.01) |

(52) U.S. Cl.

CPC . *B08B 3/045* (2013.01); *B08B 3/12* (2013.01); *B08B 3/04* (2013.01); *B08B 11/02* (2013.01); *B08B 13/00* (2013.01); *G07D 9/002* (2013.01)

(58) Field of Classification Search

None

See application file for complete search history.

(56) References Cited

U.S. PATENT DOCUMENTS 3,306,462 A * 2/1967 Cruz ..... 211/49.1

* cited by examiner

*Primary Examiner* — Jason Ko

(74) *Attorney, Agent, or Firm* — Strategy IP, a professional law corporation

(57) ABSTRACT

A system and method for securing tokens to be cleaned includes a tray with a curved surface defining a channel extending along a first direction and spacers projecting from the curved surface into the channel. The spacers are disposed at regular intervals along the first direction. The curved surface also has at least one opening. The tokens may be inserted into the channel between adjacent spacers and the tray holding the tokens can be submerged into a cleaning liquid. Identical trays containing tokens can also be stacked and together submerged into the cleaning liquid. The tray holding the tokens can be placed on a drying surface that has a drainage hole, and wetness remaining on the tokens can be sucked through the hole in the channel and the drainage hole by a vacuum or blown through the hole in the channel and drainage hole by an air blower.

5 Claims, 9 Drawing Sheets

SYSTEM AND METHOD FOR CLEANING TOKENS

BACKGROUND OF THE INVENTION

Tokens, such as gambling chips and coins, are commonly exposed to numerous germs, viruses, dirt, and filthy surfaces as they are passed from hand to hand. These tokens may then transmit these germs, viruses, and dirt to people handling them, causing sickness or even death.

Despite the dangers of handling dirty tokens, they are rarely cleaned. Coins are typically transferred so quickly that there is very little incentive for a person to clean the coins themselves, and banks handle the coins only rarely. In casinos, where gambling chips are used, they must be closely accounted for and kept on the main casino floor as much as possible. Frequently, taking large quantities of chips out of circulation in order to clean them is simply not an option.

Some systems have been developed to address these needs. In one system, tokens are dumped into a bin and hand-scrubbed. This method is time consuming and does not tend to clean the indentations and ridges of the tokens thoroughly. In another system, the tokens are dumped into a dishwasher-like machine, but each cycle may be time consuming and tokens that overlap within the machine may not be adequately cleaned.

In yet another system, tokens are dumped as a unit into various baths and an air-knife drying station, and are subjected to ultrasonic cleaning while submerged in these baths. Although a robotic arm may spin the tokens, the areas between the tokens may still be left unclean. Further, the tokens must be moved between multiple baths, and then to a separate drying station containing compressed air. This may render the system inefficient and cumbersome.

In still yet another system, tokens are inserted one-by-one through a chip washing machine via crennallated recesses in a chip wheel. Washing fluid and an air stream flow through the crennallations located at various washing and drying segments within the washing machine. Like the above-mentioned systems, however, cleaning of the tokens may be limited, and the machine may be inefficient and cumbersome.

Still other systems have been provided that attempt, through complex networks of conveyer belts, rollers, etc. to separate the tokens and clean them individually. They, however, suffer from similar problems as the systems discussed above.

SUMMARY OF THE INVENTION

According to one embodiment of the invention, a tray for securing a plurality of tokens to be cleaned includes a curved surface defining a channel extending along a first direction and spacers projecting from the curved surface into the channel and disposed at regular intervals along the first direction. The curved surface further defines an opening in the channel.

The opening can be a slit along the first direction of the curved surface, and it could be positioned at a lowermost portion of the curved surface. The curvature of the curved surface, in one embodiment, is substantially the same as peripheries of the tokens. The regular intervals may be sized to secure individual tokens between adjacent spacers. The regular intervals and widths of the spacers may also be sized to secure neighboring tokens with a spacing of approximately 0.5 mm-2 mm between adjacent faces. In one embodiment, the spacers are disposed at intervals of approximately 4.445 mm. In another embodiment, widths of the spacers are approximately 0.85 mm.

In one embodiment, a length of the tray along the first direction is substantially the same as a length of a conventional gambling chip tray, and in another embodiment, the tray also includes a supporting surface spaced above the opening to support an identical second tray in a stacked and aligned arrangement.

An embodiment of a system for cleaning tokens with a cleaning liquid according to the invention includes a tray having a curved surface defining a channel extending along a first direction and spacers projecting from the curved surface into the channel. The spacers are disposed at regular intervals along the first direction to secure individual tokens between them, and the surface has an opening. A dipper has at least one surface for supporting the tray as it is submerged into the cleaning liquid and as it is removed from submersion. A drying surface is sized to support the tray. The drying surface has a drainage opening that is positioned to correspond with the tray opening, such that drainage from the curved surface of the tray is allowed to travel through the tray opening and the drainage opening.

In one embodiment of the system, a vacuum is positioned to suck air through the tray opening and the drainage opening. In another embodiment, an air blower is positioned to blow air onto the tray, through the tray opening and the drainage opening. In yet another embodiment, a water outlet is positioned to release water onto the tray.

One embodiment includes additional trays identical to the first tray stacked on top of the first tray, the additional trays each having a curved surface defining a channel with an opening. In this embodiment, one or more surfaces of the dipper support the stacked trays while they are submerged and removed from submersion in the cleaning liquid.

Another embodiment of the system includes a basin containing the cleaning liquid. The basin is sized to receive and fully submerge the tray and the dipper inside. In one embodiment, an ultrasonic wave generator is positioned to generate ultrasonic waves in the cleaning liquid.

In one embodiment, the regular intervals of the spacers in the tray are sized to secure individual tokens between adjacent spacers, and in another embodiment, the dipper is in the form of a perforated basket or cage.

In one embodiment of a method for cleaning a plurality of tokens according to the invention, tokens and a tray as described above are provided. Individual tokens are inserted into the channel between neighboring spacers, and the tray holding the tokens is submerged into a cleaning liquid, and then removed from submersion. In one embodiment, the tokens are ultrasonically cleaned while submerged. In another embodiment, the tray holding the tokens is rinsed after being removed from submersion. The tray holding the plurality of tokens is placed on a drying surface with a drainage opening in fluid communication with the channel through the opening in the tray. In one embodiment, air is sucked from the tray through the tray opening and the drainage opening. In another embodiment, air is blown onto the tray, through the tray opening and through the drainage opening.

DETAILED DESCRIPTION OF THE INVENTION

Figure 1A:
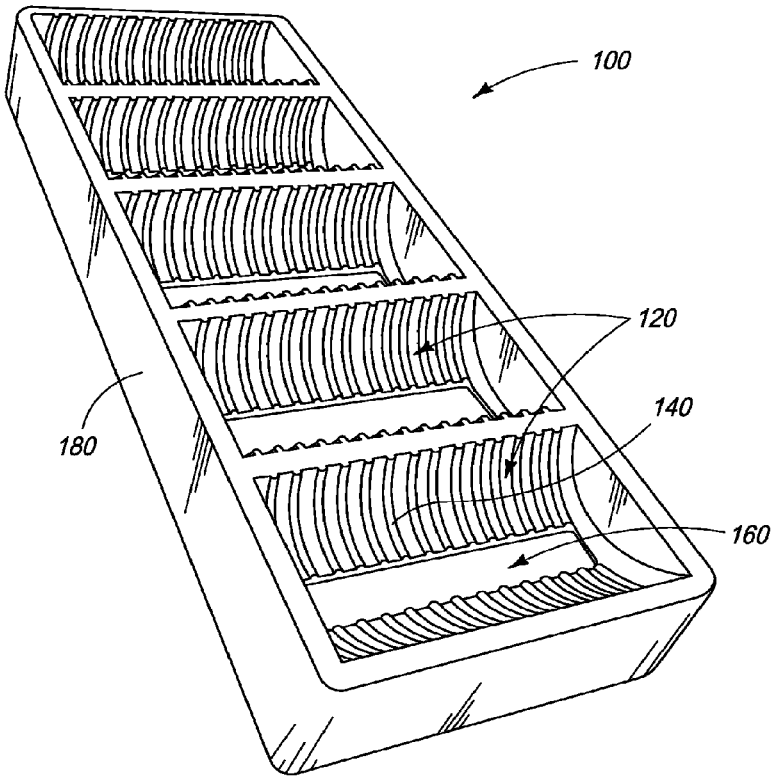
FIG. 1A is a front perspective view of one embodiment of a tray according to the invention.
Figure 1B:
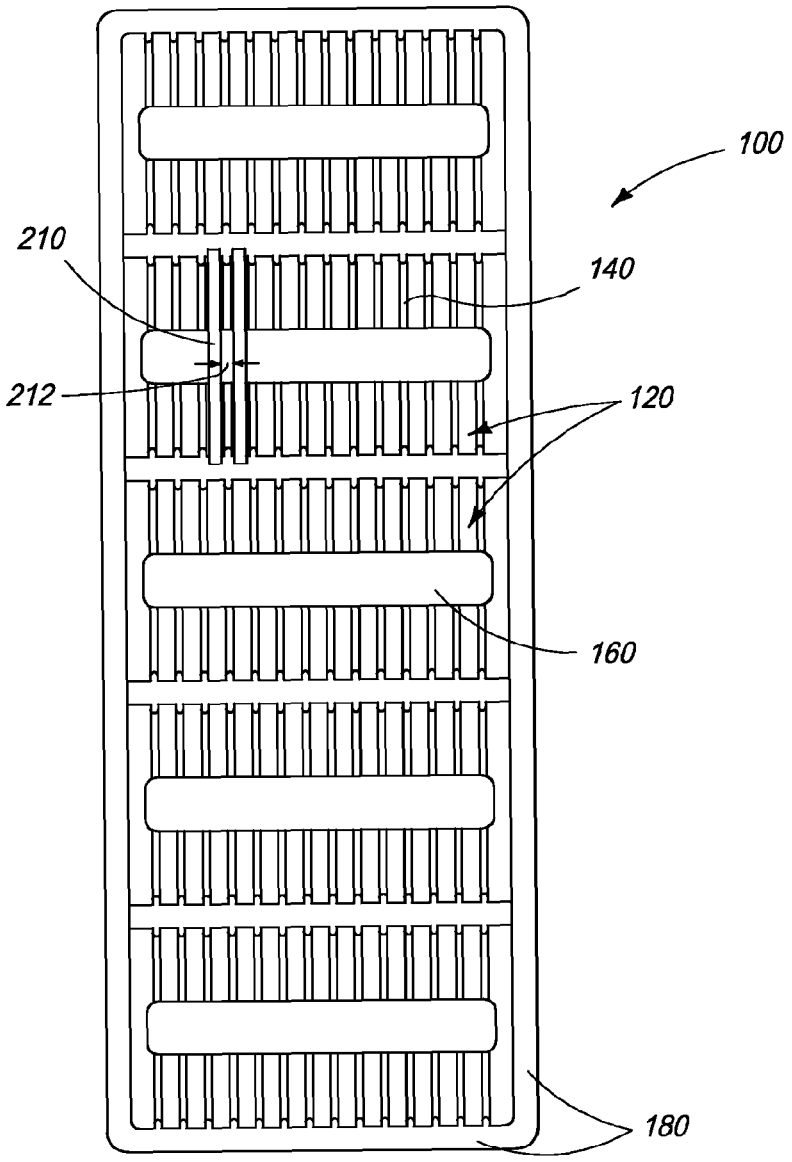
FIG. 1B is a top view of the embodiment of the tray shown in FIG. 1A.
Figure 1C:
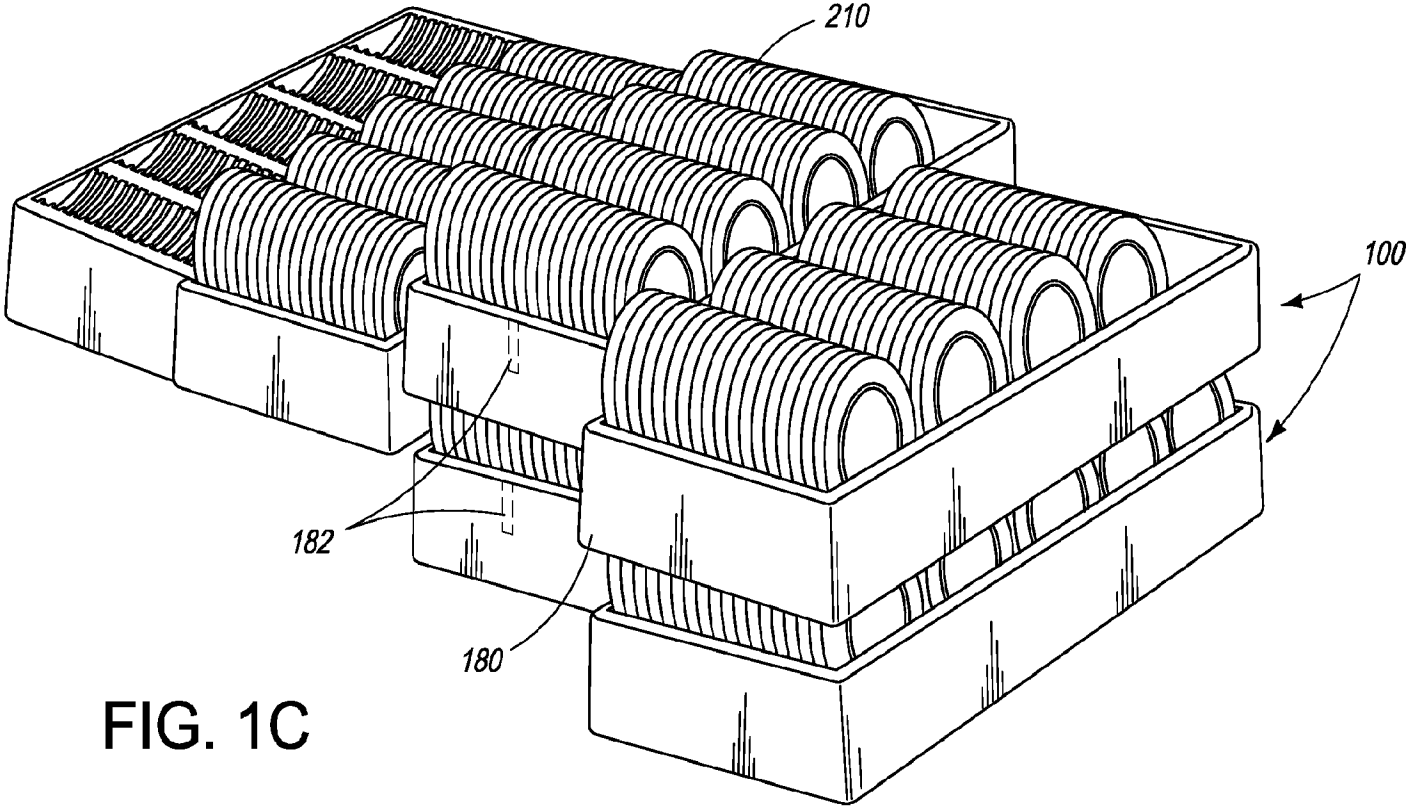
FIG. 1C is a side perspective view of the embodiment of the tray shown in FIGS. 1A-1B, shown in stacked alignment with another, identical tray.

FIGS. 1A-1C are side perspective and top views of one embodiment of a tray according to the invention. The tray 100 includes a curved surface 120 that defines a channel extending along a direction. In this preferred embodiment, the curvature of the curved surface is approximately equal to the curvature of the token 210 to be cleaned. One having ordinary skill in the art, however, may vary the curvature for various applications, such as coins and the like, or may select a larger curvature even for smaller curvature tokens for a wider variety of uses or a lower surface contact area between the token and the curved surface 120.

Referring again to the embodiment shown in FIGS. 1A-1C, the channels defined by the curved surfaces 120 are shallower than their radii of curvature. This allows the token 210 to project out of the tray 100 substantially, increasing the exposed surfaces of the token 210 for cleaning. It also provides, however, enough support for the token 210 to avoid displacement. For a standard 39 mm or 43 mm gambling chip, for example, the depth of the channel may be approximately 12.75 mm. However, it is still within the scope of the invention for the depth to be greater or lesser, as long as the desired token is sufficiently supported that it is not likely to fall out of the tray or into an adjacent channel.

In this embodiment, several curved surfaces 120 are disposed adjacent to one another, forming a series of five adjacent channels. However, it is also within the scope of the invention to dispose the channels along a different direction of tray or have a different number of adjacent channels. In this embodiment, the dimensions of the tray 100 are approximately the same as a standard gambling chip holder (not shown) to allow easy transfer of gambling chips 210 from such a holder to the tray 100 and allow the tray 100 to fit into standard sized chip carriers. It is also within the scope of the invention, however, for the tray to be any dimensions appropriate to the application.

Projecting from the curved surfaces 120 into the empty space of the channels are spacers 140. These spacers 140 are disposed at regular intervals along the same direction in which the channels extend, and the tokens 210 are disposed between neighboring spacers 140 so that they are spaced from each other by a certain distance 212. The curved surfaces 120 also define openings 160, which, in this embodiment, are slits extending in the same direction as the channels at the lowermost portion of the curved surfaces 120. It is also within the scope of the invention for a curved surface 120 to have more than one opening in various shapes and sizes to suit a particular need. In this preferred embodiment, the openings 160 are narrower than the diameter of the token 210 to be cleaned, so that the token 210 can be supported within the tray 100. The openings 160 are also wide enough to allow liquids to drain out of them freely. In this embodiment, there are fourteen spacers 140 per channel disposed on either side of the openings 160, allowing fifteen tokens 210 per channel to be supported between neighboring spacers 140 and supporting surfaces 180. It is, however, within the scope of the invention to include a greater or lesser number of spacers 140.

In this embodiment, supporting surfaces 180 project down below the series of curved surfaces 120 so that the curved surfaces 120 are spaced from whatever surface is supporting the tray 100. The supporting surfaces 180 also provide a flat supporting edge for the tray 100 and allow multiple trays to be stacked upon one another. In this embodiment, the supporting surface 180 also includes a spacing member 182, which supports the tray 100 above the tokens 210 in the loaded tray 100 below.

As shown in FIGS. 1A-1C, the curved surfaces 120, spacers 140, and supporting surface 180 are formed of one, continuous piece of translucent acrylic. However, it is also within the scope of the invention for each element to be formed separately and fixed together. It is also within the scope of the invention for the elements to comprise any other suitable material that is sufficiently rigid to support the tokens 210.

Figure 2:
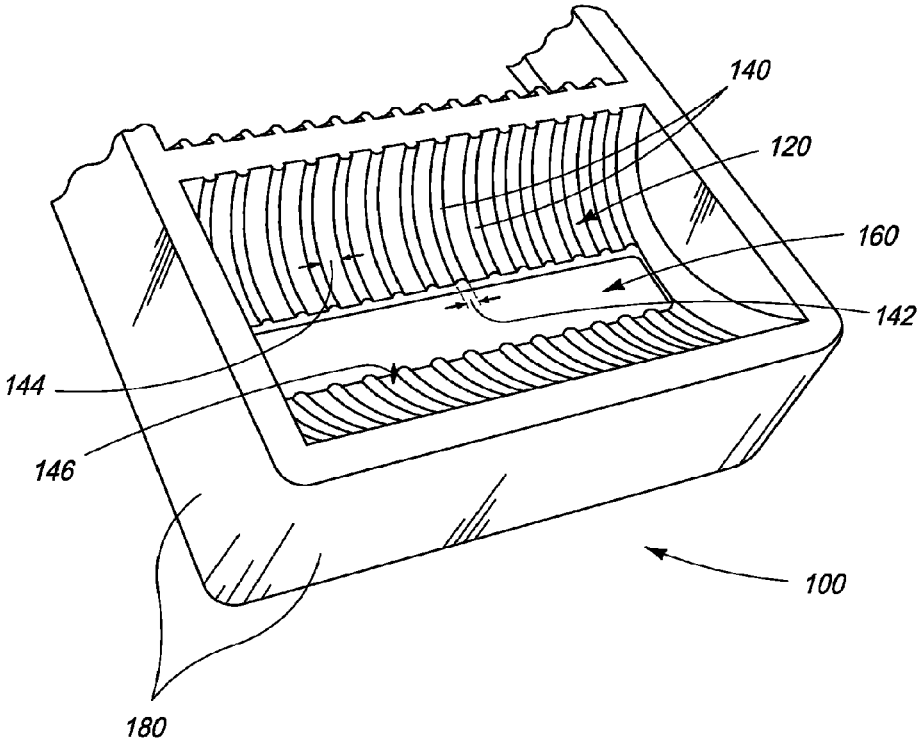
FIG. 2 is a detailed perspective view of the embodiment shown in FIGS. 1A-1C.

FIG. 2 shows a detail perspective view of the tray of FIGS. 1A-1C. As seen in FIG. 2, the spacers 140 have a width 142 and are spaced at regular intervals 144 along the curved surface 120. These regular intervals are preferably equal to or slightly larger than a height of the token to be cleaned plus the width 142 of the spacer. The width of the spacer 142 is preferably large enough to allow cleaning fluid and/or ultrasonic cleaning through cavitation in between the token faces (212 in FIG. 1B). For standard gambling chips with a height of 3 mm, for example, this interval may be set at approximately 4.85 mm, where the width of the spacer is set at 0.85 mm and the space between each spacer would therefore be approximately 4 mm. In another embodiment, the space between each spacer is approximately 4.5 mm, with a 0.85 mm-wide spacer for a 3 mm high gambling chip. It is also within the scope of the invention, however, for the width and interval to have different suitable values.

The spacers 140 project into the channel 120 by a certain height 146. The height 146 is preferably high enough to keep an individual token between neighboring spacers 140, but low enough to allow cleaning fluid and/or ultrasonic cleaning to enter the space between neighboring individual tokens. For ultrasonic cleaning, sufficient space between the tokens is preferred to allow dirt to separate from the surface of the tokens through conventional ultrasonic mechanisms. For standard gambling chips, for example, a height 146 of 1.85 mm is effective for securing the chips between the spacers 140 while allowing enough space for cavitation that takes place during ultrasonic cleaning. Various other spacer heights 146, however, may be substituted as appropriate within the scope of the invention.

As shown in FIGS. 1 and 2, the spacers 140 are in the form of ridges on opposite sides of the opening 160. It is within the scope of the invention, however, for the spacers to be in any effective form, such as a single ridge unbroken by an opening, curved channels, walls, or one or more bumps, spurs, protrusions, etc. projecting into the channel.

Tokens, such as gambling chips, coins, arcade tokens, etc. (not shown), can be inserted into the tray 100 by inserting individual tokens between neighboring spacers 140. This allows the individual tokens to be spaced from each other and moved through multiple steps of a cleaning process while keeping most of each token surface exposed to the cleaning and drying agents. This chip separation increases the effectiveness of the cleaning, is less cumbersome, and allows continuous operation of the cleaning system. Embodiments of a system according to the invention will now be described.

Figure 3:
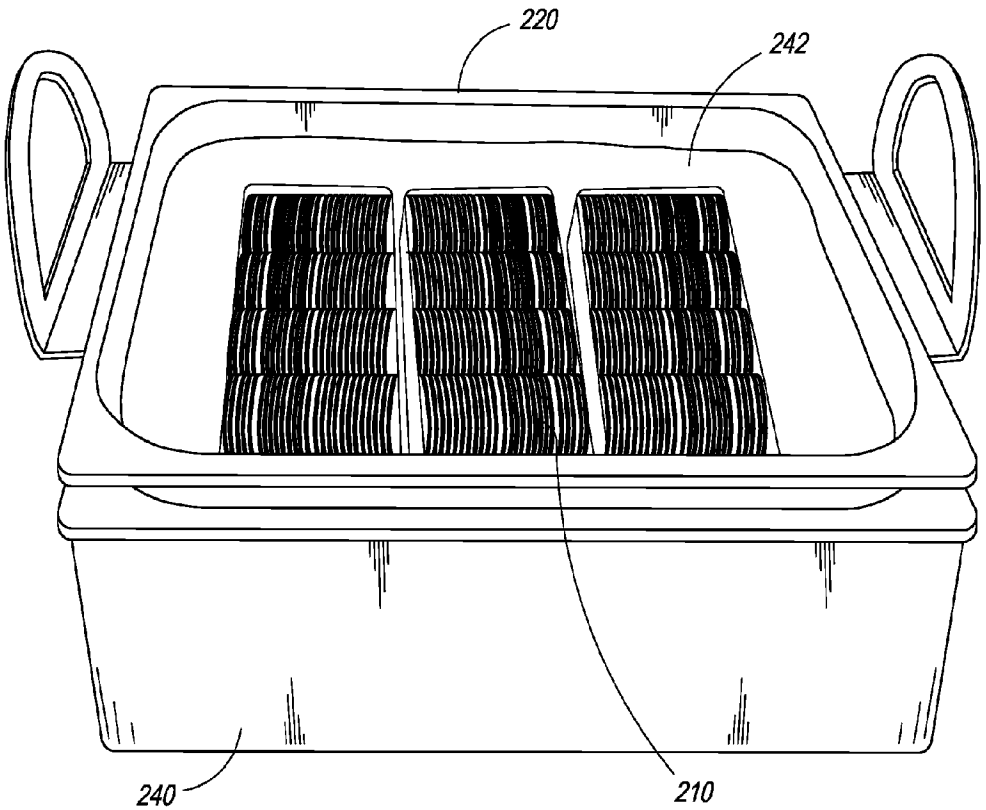
FIG. 3 is a top perspective view of one embodiment of an ultrasonic cleaning system according to the invention.
Figure 4:
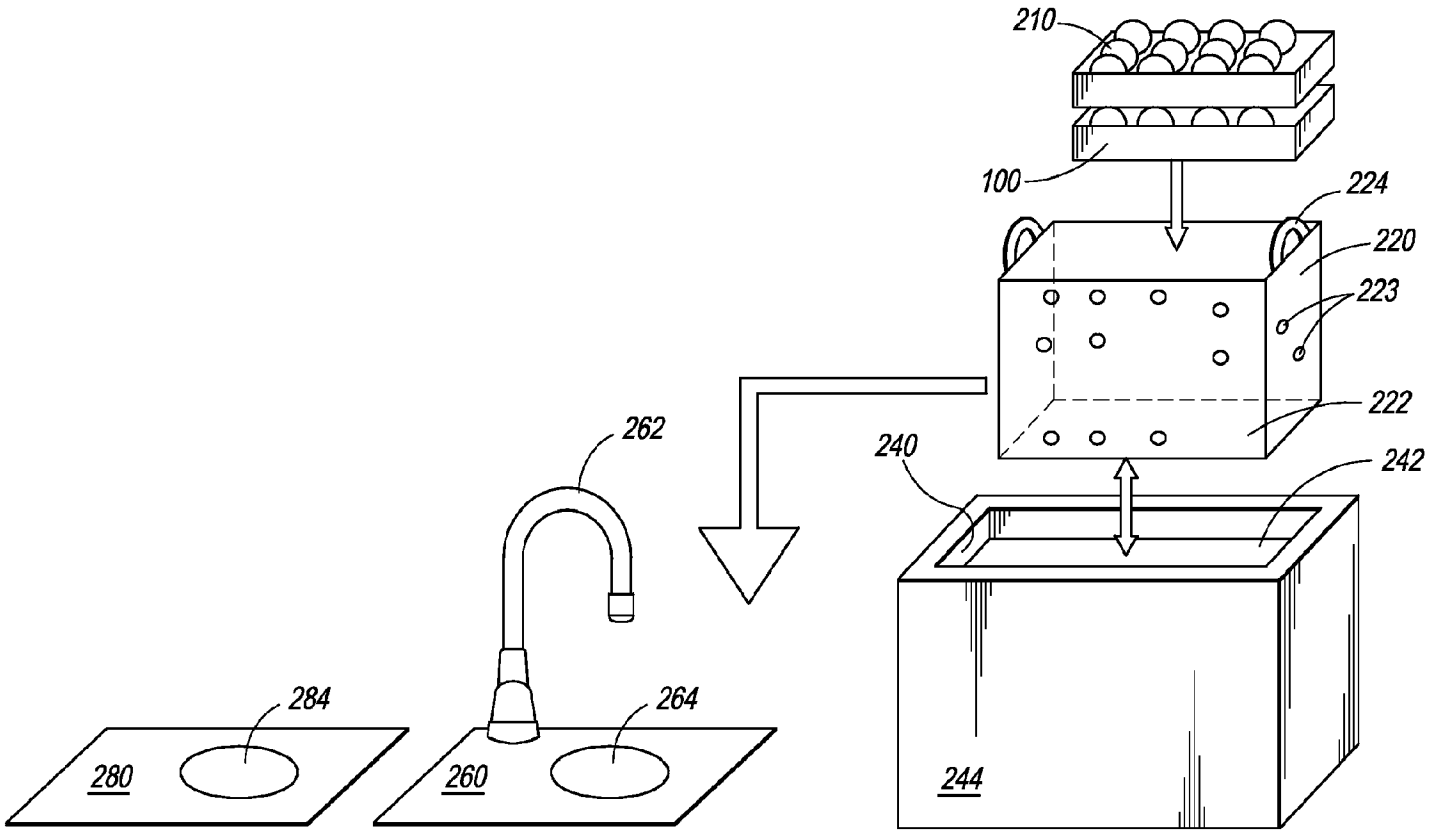
FIG. 4 is a front view of one embodiment of a system according to the invention including the ultrasonic cleaning system shown in FIG. 3.

Referring now to FIGS. 3-4, an embodiment of a system 200 for cleaning tokens 210 includes a tray 100 as described in FIGS. 1 and 2, a dipper 220, a basin 240, a rinsing station 260, and a drying surface 280. The dipper 220 has at least one surface 222 for supporting the tray 100 as it is submerged into and out of cleaning liquid 242, such as detergent or water, in the basin 240. In this embodiment, the dipper 220 is in the form of a basket, with perforations 223 and handles 224, which allows the cleaning liquid 242 to permeate its walls freely when the tray 100 and dipper 220 are submerged. The perforated basket 220 is sized to hold the tray 100 or several identical trays, that may be stacked and/or laid adjacent to one another on the surface 222 of the dipper 220. It is also within the scope of the invention, however, for the dipper 220 to be formed as a cage, a forked handle, or any other configuration having one or more supporting surfaces that support a tray 100 as it is submerged and removed from submersion in the cleaning liquid 242.

In this embodiment, the basin 240 includes an optional ultrasonic wave generator 244 that generates ultrasonic waves within the cleaning liquid 242. It is also within the scope of the invention, however, for the basin to be provided without such a generator 244. In one preferred embodiment of the invention, the cleaning liquid is formed from a powder added to water, such as the DP2300 General Purpose Cleaning Powder supplied by Diversified Chemical Products. As the tokens 210 are spaced from each other in the tray 100, dirt and other contaminants on the surfaces of the tokens 210 are exposed to the cleaning liquid 242, the ultrasonic process is able to separate those impurities from the token surfaces through cavitation, and then allow the impurities to float to the surface of the liquid, and away from the tokens 210. Once the tokens 210 are clean, the dipper 220 holding the trays 100 and the tokens 210 can then be removed from submersion, with excess cleaning liquid 242 draining from the tray openings 160 and the perforations in the dipper 220. Although removal from submersion is shown as lifting the dipper 220 out of the cleaning liquid 242, it is also within the scope of the invention for the cleaning liquid 242 to be drained from the basin or by any other means of removing the tray and dipper from submersion.

In this embodiment, the dipper 220 is then moved with the trays 100 and tokens 210 to an optional rinsing station 260, which includes a water outlet 262 and a drainage opening 264. The trays 100 containing the tokens 260 can then be rinsed by water from the water outlet 262 while they are still in the dipper 220, allowing the water to reach the exposed surfaces between the tokens 210 due to the spacing between them. The water then drains from around the trays 100, through the openings 160, through the openings in the dipper 220, and through the drainage opening 264.

Although FIG. 4 shows the loaded trays 100 being rinsed while inside the dipper 220, it is also within the scope of the invention for the loaded trays 100 to be rinsed outside of the dipper 220, either alone or in stacked alignment with each other. Further, the drainage opening 264 may be positioned to be in fluid communication with the opening of 160 of the trays 100, or the trays 100 may be moved back and forth over the drainage opening 264 to allow for different portions of the opening 160 to allow fluid communication through the drainage opening 264 at different times.

Figure 5:
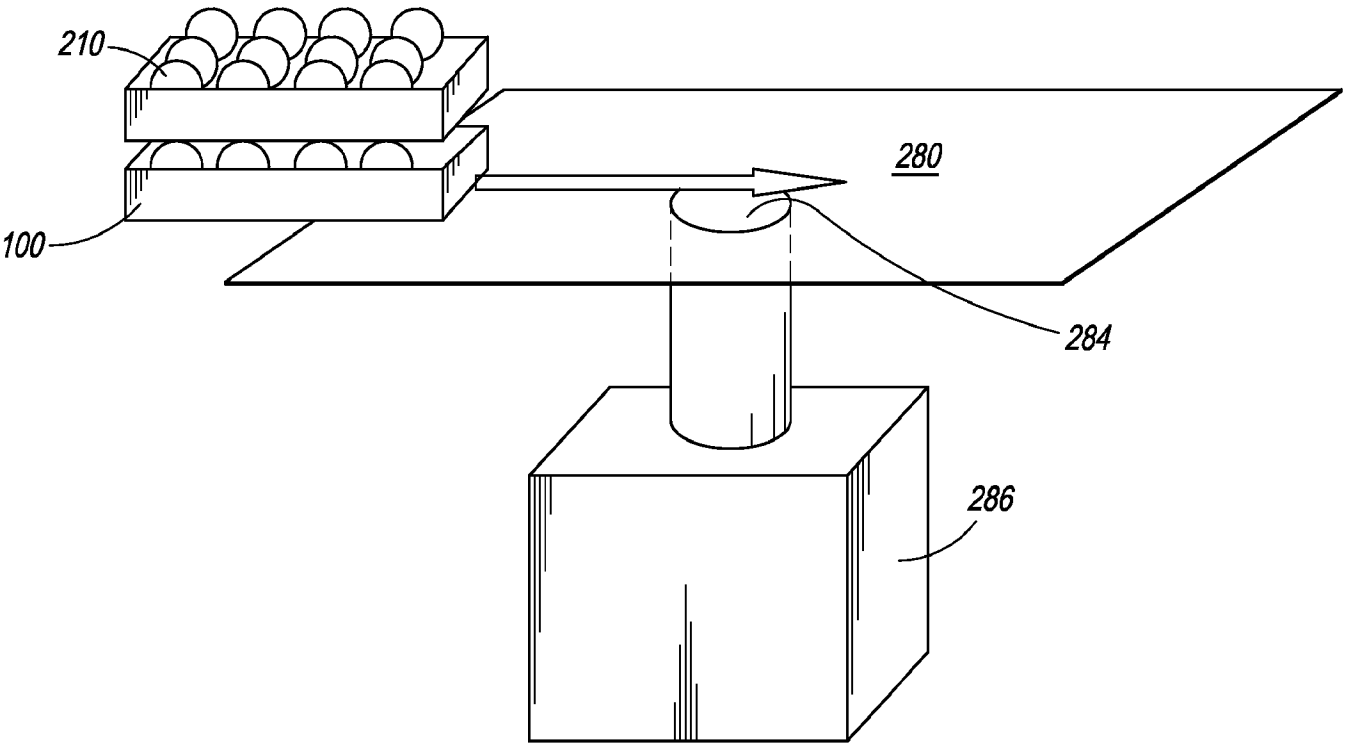
FIG. 5 is a perspective view of one embodiment of the drying station shown in FIG. 4.

Referring now to FIGS. 4-5, a drying surface 280, which can support the tray 100, also includes a drainage opening 284, positioned to allow fluid communication through the opening 160 of the trays 100 to the drainage opening 284, as discussed above. Drainage from the curved surface 120 of the tray 100 is therefore allowed to travel through the opening 160 of the tray 100 and through the drainage opening 284. In this embodiment, a vacuum 286 is connected to the drainage opening 284 to allow air and moisture to be sucked from inside the curved surfaces 120 of the trays 100, through the openings 160, and through the drainage opening 284.

Figure 6:
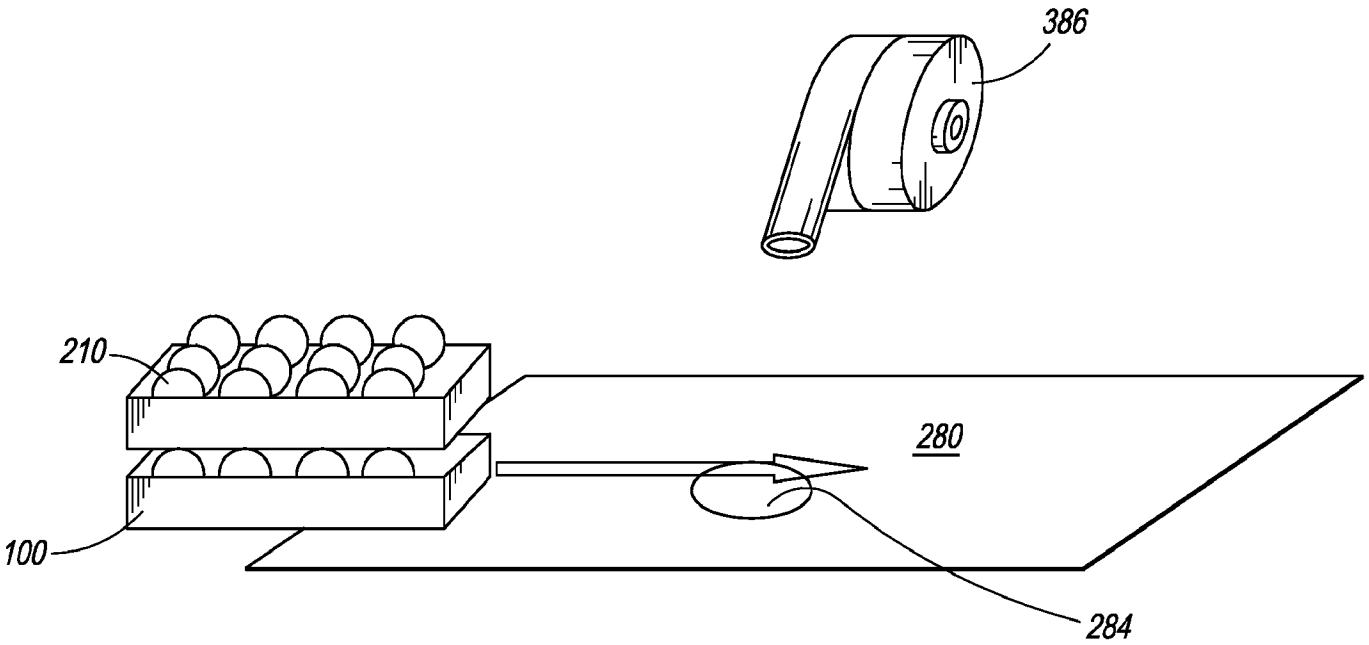
FIG. 6 is a perspective view of an alternate embodiment of a drying station according to the invention.

As shown in FIG. 6, an alternate embodiment includes an air blower 386 positioned to blow air onto the top of the trays 100, forcing air and moisture out of the trays 100 through the tray openings 160 and through the drainage opening 284, thus allowing drying of the tokens 210 without time-consuming and damaging hand wiping or removal of the tokens 210 from the trays 100.

Although FIGS. 3-6 show embodiments of the system to include a separate drying station with a drying surface 280 and drainage opening 284, it is also within the scope of the invention to avoid a drying station altogether, and to allow drainage of the trays through the drainage opening 264 through, for example, gravity, vacuum or air blowing.

Figure 7:
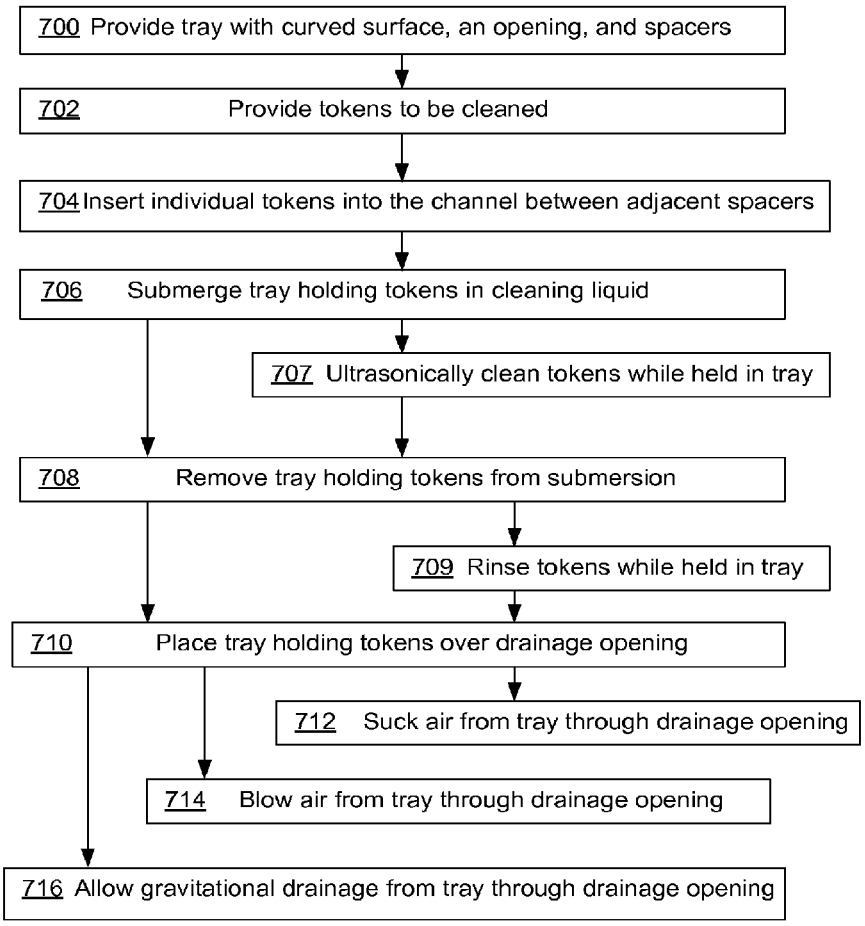
FIG. 7 is a process flow diagram showing one embodiment of a method according to the invention.

FIG. 7 is a process flow diagram of a method of cleaning tokens according to one embodiment of the invention. A tray with a curved surface defining a channel and an opening in a lower portion of the channel is provided (700). The tray includes spacers disposed at regular intervals along and projecting into the channel. Tokens to be cleaned are also provided (702).

Individual tokens are then inserted into the channel between adjacent spacers (704), and the tray holding the tokens is submerged into a cleaning liquid (706). The tokens can then be optionally ultrasonically cleaned (707).

The tray holding the tokens is removed from submersion (708), and can then be optionally rinsed (709) and placed on a drying surface (710). The drying surface has a drainage opening in fluid communication with the channel through the opening in the tray to allow drainage.

In various embodiments, air can be sucked (712), blown (714), or simply gravitationally drained (716) from the tray through the tray opening and finally through the drainage opening.

The embodiments of the invention described herein are illustrative, rather than restrictive. Modification may be made without departing from the spirit of the invention as defined by the following claims and their equivalents.

What is claimed is:

1. A method for cleaning gambling tokens, the method comprising:

providing a tray having a curved surface defining a channel and an opening in a lower portion of the channel, the tray further comprising spacers disposed at regular intervals along and projecting into the channel;

providing gambling tokens to be cleaned;

inserting individual ones of the tokens into the channel between adjacent ones of the spacers;

submerging the tray holding the tokens into a cleaning liquid;

removing the tray holding the tokens from submersion; and placing the tray holding the tokens on a drying surface having a drainage opening in fluid communication with the channel through the opening in the tray.

2. The method of claim 1, further comprising sucking air from the tray through the opening in the tray and the drainage opening.

3. The method of claim 1, further comprising blowing air onto the tray and through the opening in the tray and the drainage opening.

4. The method of claim 1, further comprising ultrasonically cleaning the tokens while they are held in the tray and submerged.

5. The method of claim 1, further comprising rinsing the tray holding the tokens after they are removed from submersion in the cleaning liquid.

* * * * *